US009585491B2

(12) United States Patent
Cox et al.

(10) Patent No.: US 9,585,491 B2
(45) Date of Patent: Mar. 7, 2017

(54) AIR MATTRESSES HAVING INTERNAL DIAGONAL SUPPORT STRUCTURES

(71) Applicant: LSO LP, San Diego, CA (US)

(72) Inventors: Brian P. Cox, San Diego, CA (US); Cynthia Brooks, San Diego, CA (US)

(73) Assignee: LSO LP, San Diego, CA (US)

( * ) Notice: Subject to any disclaimer, the term of this patent is extended or adjusted under 35 U.S.C. 154(b) by 210 days.

(21) Appl. No.: 14/527,130

(22) Filed: Oct. 29, 2014

(65) Prior Publication Data

US 2015/0113736 A1 Apr. 30, 2015

Related U.S. Application Data

(60) Provisional application No. 61/897,798, filed on Oct. 30, 2013.

(51) Int. Cl.
*A47C 27/08* (2006.01)

(52) U.S. Cl.
CPC ..... *A47C 27/087* (2013.01); *A47C 27/081* (2013.01)

(58) Field of Classification Search
CPC ..... A47C 27/08
USPC ..... 5/706, 710, 644, 655.3
See application file for complete search history.

(56) References Cited

U.S. PATENT DOCUMENTS 5,152,018 A * 10/1992 Lea ..... A41D 31/0038 428/71
2011/0030144 A1* 2/2011 Flick ..... A61G 7/05769 5/706

* cited by examiner

*Primary Examiner* — Fredrick Conley
(74) *Attorney, Agent, or Firm* — Norman E. Lehrer

(57) ABSTRACT

This disclosure relates generally to inflatable mattresses in the form of beds, chairs, couches, or other gas-inflatable structures. The mattress has an internal support structure with one or more diagonal structural support elements comprised of rigid or flexible cords or cables that are coupled to the top, bottom, and/or sides of the air mattress. The support elements provide increased top-to-bottom, side and/or corner rigidity when subject to top loading. The mattress may also include an integral handle structure so as to allow a user to readily lift and/or transport the air mattress when inflated.

17 Claims, 16 Drawing Sheets

AIR MATTRESSES HAVING INTERNAL DIAGONAL SUPPORT STRUCTURES

CROSS REFERENCE TO RELATED APPLICATION

This application claims the benefit of Provisional Patent Application No. 61/897,798 filed Oct. 30, 2013.

FIELD

This disclosure relates generally to inflatable mattresses in the form of beds, chairs, or other structures. More specifically, but not exclusively, the disclosure relates to inflatable air beds or other inflatable structures having an internal diagonal structure comprising rigid or flexible cords or cables.

BACKGROUND

Air or gas inflatable structures are well known in the art. A common air-inflatable structure is made in the form of a bed or mattress for relaxing or sleeping on.

Some types of existing air mattresses have internal structures based on vertically-oriented cords (vertical orientation is in reference to the ground, floor, or other substantially flat surface on which the air mattress is placed) connecting a top structure, typically in the form of a plastic sheet, and a similar bottom structure. While these mattresses can provide increased comfort relative to a purely air-filled mattress, they are subject to various deficiencies, such as adding pressure points at some locations and/or depressing at other locations.

Accordingly, there is a need in the art to address the above-described as well as other problems related to gas inflatable mattresses and other structures such as chairs, other furniture, air-inflatable support platforms, and the like.

SUMMARY

This disclosure relates generally to inflatable mattresses in the form of beds, chairs, couches, or other gas-inflatable structures. More specifically, but not exclusively, the disclosure relates to inflatable air beds or mattresses having an internal support structure with one or more diagonal structural support elements comprising rigid or flexible cords or cables.

For example, in one aspect, the disclosure relates to an air mattress having one or more internal support structures configured in a diagonal orientation relative to standard vertical air mattress structural support elements. The structural support elements may, for example, be rigid or flexible cords, cables, inflatable members, or other support structures that are coupled to the top, bottom, and/or sides of the air mattress.

In another aspect, the disclosure relates to an air mattress having one or more internal support structures such as cords, cables, or other structural support elements coupled to one or more tops, sides, and/or corners of the air mattress so as to provide increased top-to-bottom, side and/or corner rigidity when subject to top loading.

In another aspect, the disclosure relates to an air mattress including an integral handle structure so as to allow a user to readily lift and/or transport the air mattress when inflated.

In another aspect, the disclosure relates to methods for making the above-described air mattresses or other gas-inflatable structures, in whole or in part.

Various additional aspects, features, and functionality are further described below in conjunction with the appended Drawings.

BRIEF DESCRIPTION OF THE DRAWINGS

The present disclosure may be more fully appreciated in connection with the following detailed description taken in conjunction with the accompanying drawings, wherein.

DETAILED DESCRIPTION OF EMBODIMENTS

This disclosure relates generally to inflatable mattresses in the form of beds, chairs, couches, or other gas-inflatable structures. More specifically, but not exclusively, the disclosure relates to inflatable air beds or mattresses having an internal support structure with one or more diagonal structural support elements comprising rigid or flexible cords or cables.

For example, in one aspect, the disclosure relates to an air mattress having one or more internal support structures configured in a diagonal orientation relative to standard vertical air mattress structural support elements. The support elements may, for example, be rigid or flexible cords, cables, inflatable members, or other support structures that are coupled to the top, bottom, and/or sides of the air mattress.

In another aspect, the disclosure relates to an air mattress having one or more internal support structures such as cords, cables, or other support elements coupled to one or more tops, sides, and/or corners of the air mattress so as to provide increased top-to-bottom, side and/or corner rigidity when subject to top loading.

In another aspect, the disclosure relates to an air mattress including an integral handle structure so as to allow a user to readily lift and/or transport the air mattress when inflated.

In another aspect, the disclosure relates to methods for making the above-described air mattresses or other gas-inflatable structures, in whole or in part.

Various additional aspects, features, and functionality are further described below in conjunction with the appended Drawings.

Figure 1A:
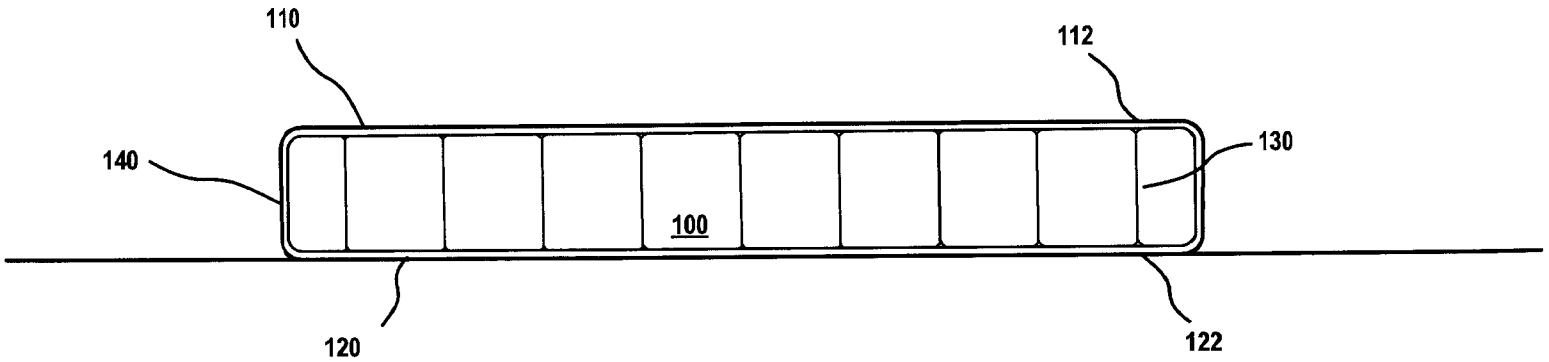
FIG. 1A PRIOR ART
FIG. 1A is an illustration of a side cutaway view of a prior art air mattress having internal vertical cords coupled between a top structure and a bottom structure to add rigidity.
Figure 1B:
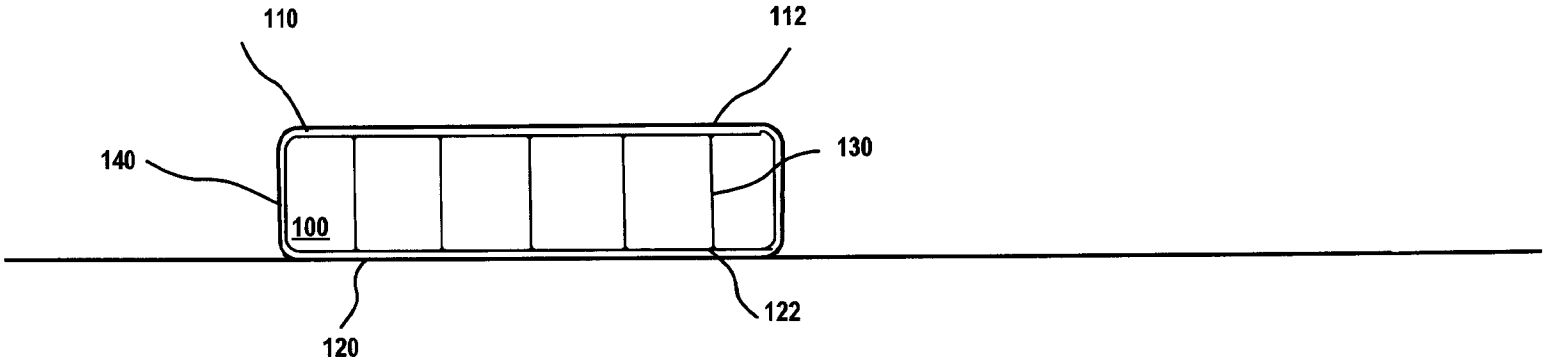
FIG. 1B PRIOR ART
FIG. 1B is an illustration of the air mattress or FIG. 1A from another side view.
Figure 1C:
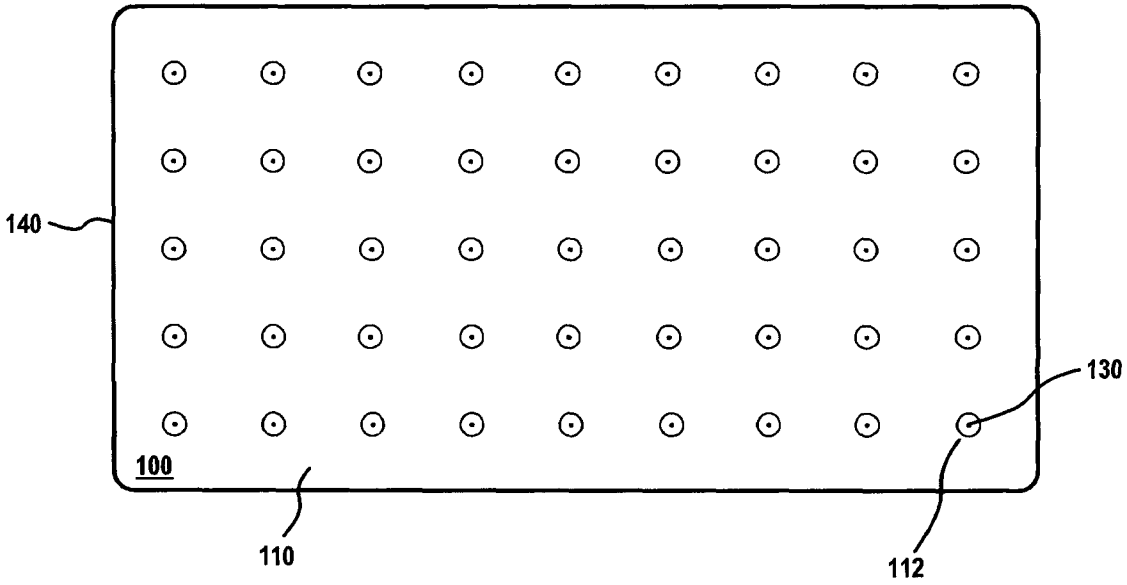
FIG. 1C PRIOR ART
FIG. 1C is an illustration of the air mattress of FIG. 1A from a top view.
Figure 2:
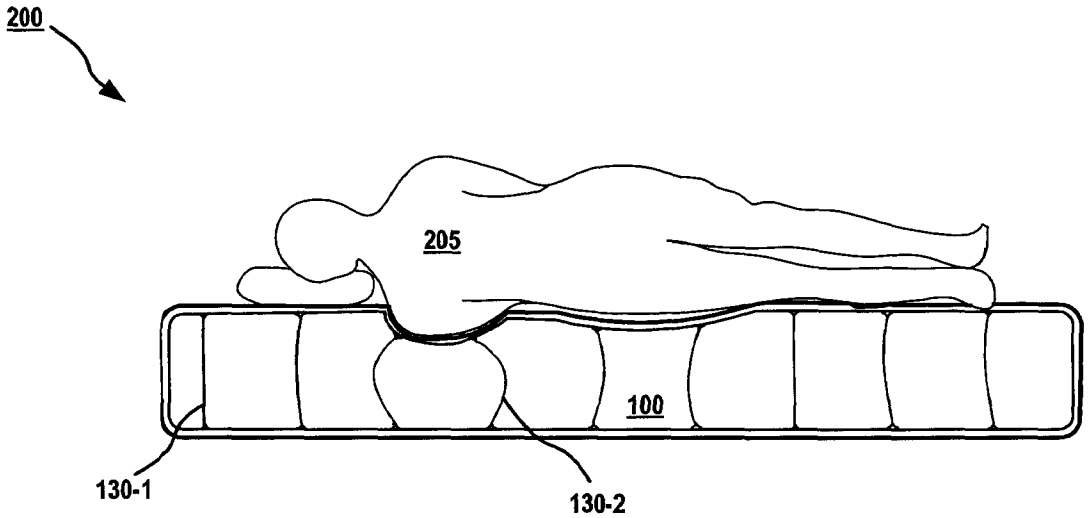
FIG. 2 is an illustration of the air mattress of FIG. 1 with a load placed on the top surface (e.g., a person laying or sleeping on the air mattress)

Attention is now directed to FIG. 1A and FIG. 1B, which illustrate details of a prior art air mattress 100 as seen from a side view with the mattress resting on a floor or other surface. As shown in FIG. 1A, air mattress 100 includes a top 110, a bottom 120, and one or more sides 140. The sides 140 may be formed, in some implementations, by merely bonding the top and bottom, however, in other air mattress configurations, separate side pieces may be used and bonded to the top and bottom through use of adhesive, plastic welding, or other bonding techniques. Internally, air mattress 100 may include one or more vertical support element 130, which are typically cords of synthetic material or straps. Support elements 130 are denoted as vertical with respect to the loaded position when the loading (e.g. a human lying on the air mattress such as shown in FIG. 2) is applied to the top of the mattress. In FIG. 1A, vertical orientation is along the Y axis as shown. FIG. 1B illustrates mattress 100 in cross-section along another side showing a similar internal vertical structural support element construction with support elements 130. FIG. 1C illustrates a corresponding top view of the air mattress 100, which shown how the mattress looks when viewed from above while being placed on a floor or the ground. Element 130 in this view go in and out of the page along the Y axis, which is perpendicular to the X and Z axes as shown.

FIG. 2 illustrates the effects 200 of loading on the air mattress 100 when a human 205 is laying or sleeping on the mattress. As shown in FIG. 2, while some of the vertical support elements 130 (e.g., element 130-1 as shown) may remain essentially vertically upright if little or no load is placed on them, others (e.g., 130-2) may bend or sage when a load is applied. Moreover, in this configuration, minimal cross-sectional support is provided and comfort to the user may be less than desirable.

Figure 3A:
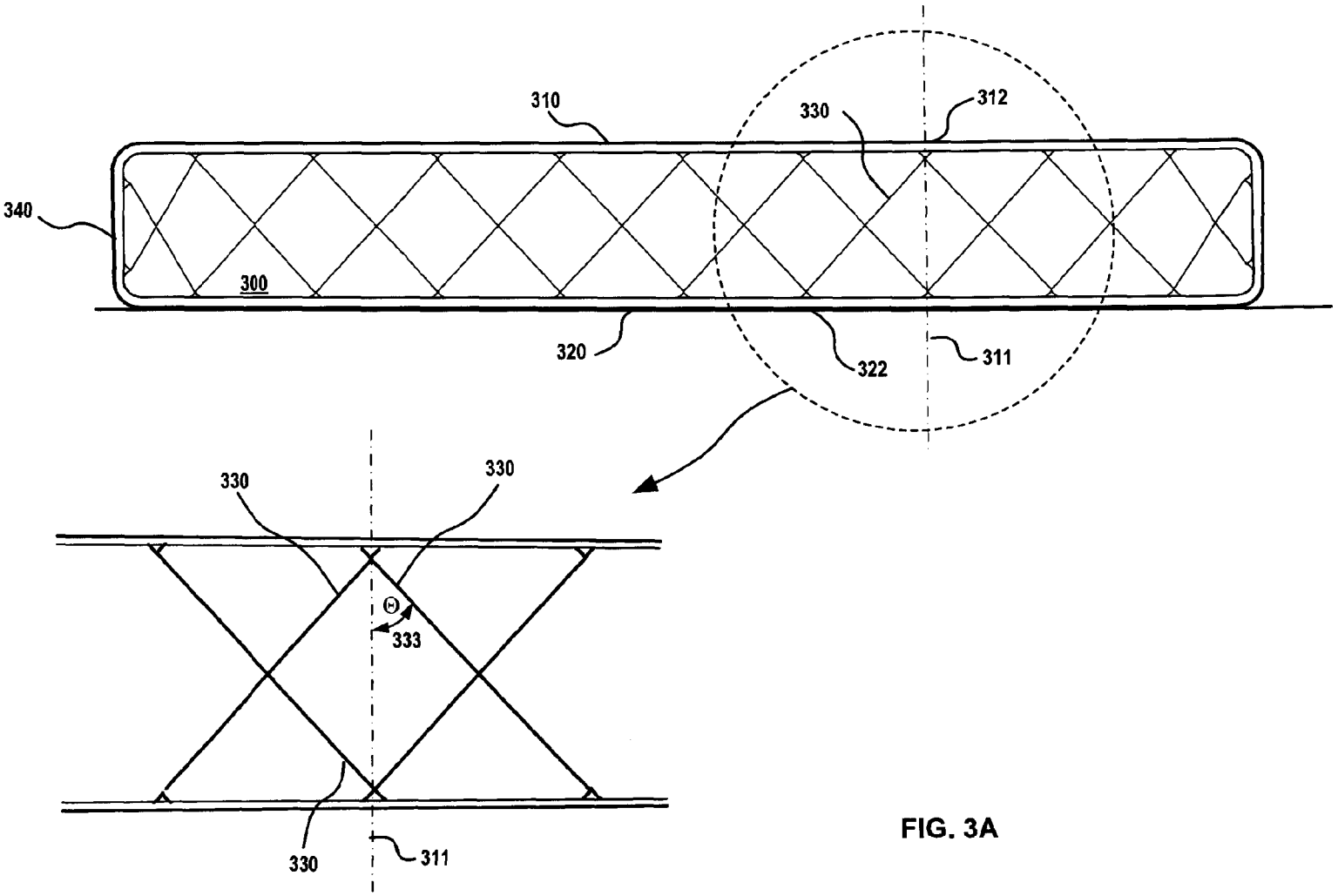
FIGS. 3A-3C illustrate details of one embodiment of an air mattress having internal diagonal structural support elements, in accordance with one aspect of the present disclosure.
Figure 3B:
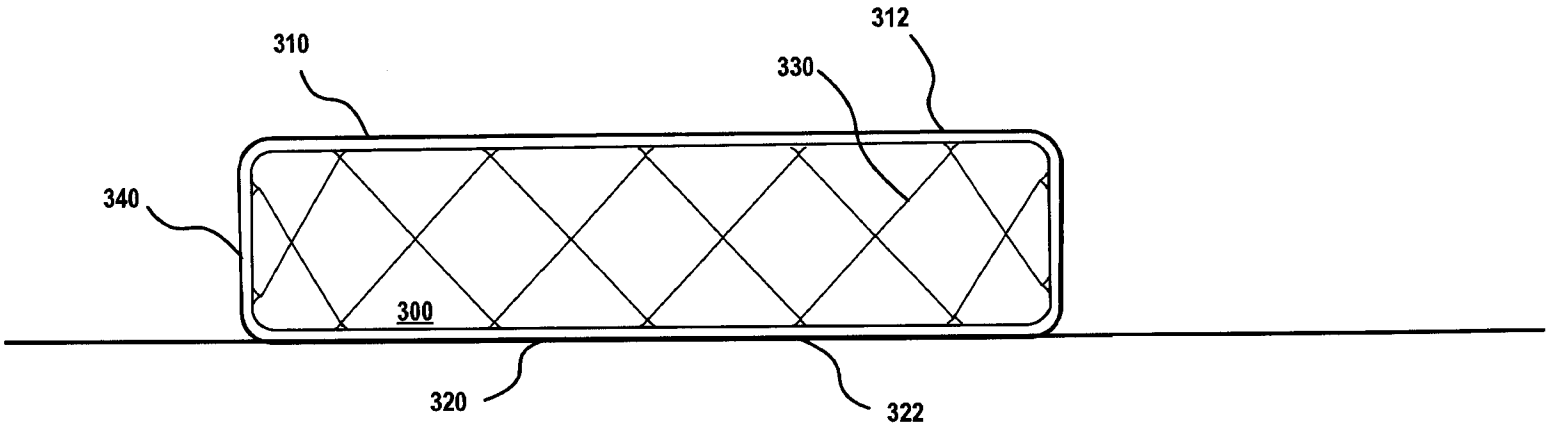
Figure 3C:
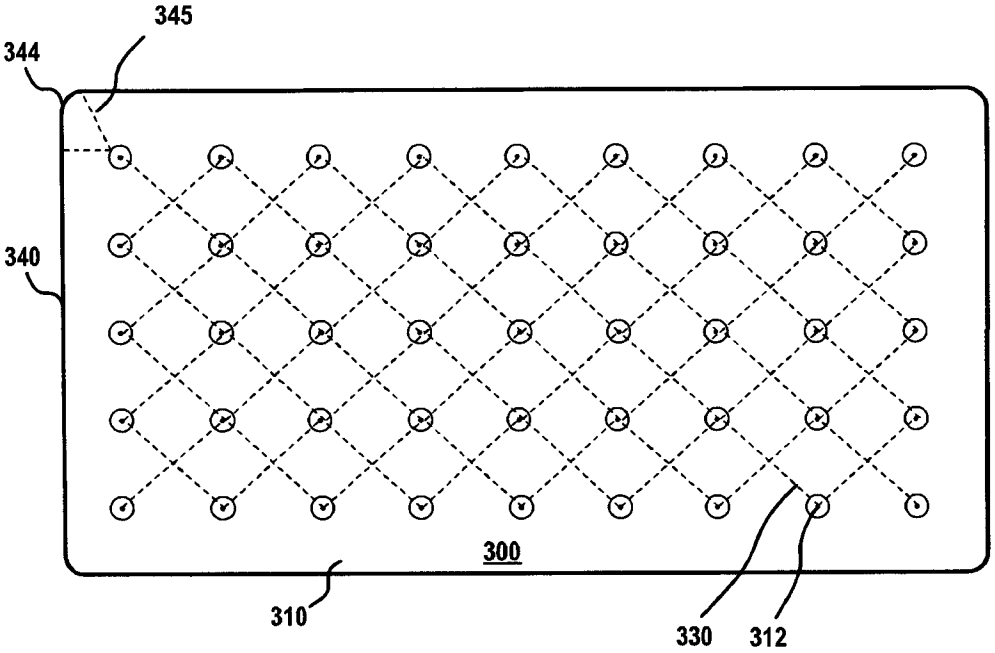

Accordingly, to provide a more rigid and/or comfortable air mattress or other gas-inflatable structure, diagonal support elements may be used in various configuration to replace and/or supplement the traditional vertical support elements as shown in FIGS. 1A-1C. One such embodiments is shown in FIGS. 3A-3C, which illustrate details of one aspect of the present disclosure regarding air mattresses or other air or gas-inflatable structures that include an internal support structure in a diagonal configuration.

It is noted that, as described herein, a diagonal support element (or corner or side support element in certain embodiments wherein side and/or corner connections are used) may be any of a rigid or flexible element coupled either fixedly or movable between two or more structures (e.g., top and bottom or side surfaces, sheets, etc. of the air-inflatable structure). A typical support element may be a cord or cable or synthetic materials; however, alternate embodiments may include elements such as strings, straps, chains, bands, inflatable elements, and the like. The diagonal support elements as described herein may be bonded or coupled to various top, bottom, and/or side structures, which are typically in the form of plastic sheets of materials such as PVC or TPU. Additional attachment structures, such as bonding pads, hooks, loops, bands, etc., may be attached to the top, bottom, and/or side structures to aid in attaching the diagonal (and/or vertical) support elements and increasing strength at the attachment points.

As used herein, a support element in a diagonal configuration refers to a support element that is oriented at an angle relative to a vertical elements of the structure when in normal use. A traditional vertical support element 130 is shown in FIG. 1, while diagonal support elements are illustrated in various embodiments from FIG. 3A through the end of this disclosure. For example, as shown in FIG. 3A in cross-section, an air mattress embodiment 300 is shown in cross-section as it would be placed on a level floor. A vertical axis 311 intersects top structure 310 (e.g., a PVC or other sheet material, etc.) and a bottom structure at approximately a 90 degree angle. A diagonal support element 330 is offset from the vertical by an angle Θ (Theta) as shown. As noted previously with respect to FIG. 1, traditional air mattresses use only vertical elements coupled between the top and bottom surfaces (e.g., along axis 311 as shown). In various embodiments, alternate and/or additional structural support elements in a diagonal configuration may be included to improve air mattress structural performance and/or comfort.

Returning to FIG. 3A, air mattress embodiment 300 may include a top structure 310, such as a PVC or TPU sheet or other material, a bottom structure 320, which may be of the same or different type of material, and one or more sides 340. In some embodiments the top structure may be bonded directly to the bottom structure without need for additional side elements during construction, with an equivalent to the side being formed by the bonding of the top and bottom. In various configurations, one or more diagonal support elements 330 may be internally coupled between the top structure 310 and bottom structure 320 (and/or in some embodiments as described subsequently herein, to corners and/or sides). The support elements may comprise an internal support structure and may attach to the top and/or bottom structures (and/or to the sides 340) at connection points 312, which may be fixed or movable connection points (e.g., glued or sewn connections, welded connections, hooks or loops, bands, etc.). The diagonal support elements are offset from the vertical (in the configuration shown) at a non-zero angle Θ (Theta) (333 in FIG. 3A), as shown.

FIG. 3B illustrates a corresponding view of the air mattress embodiment 300 in a cutaway view from another side, illustrating one example internal connection configuration. As shown in FIG. 3B, the structural support elements 330 may be coupled to the sides/corners of the air mattress 300 in certain embodiments or may be coupled, in alternate embodiments, only to the top and bottom structures 310 and 320. A bottom structure connection point 322 is further shown in FIG. 3B illustrating a configuration where a single structural support element 330 is connected at one end to the top structure 310 at connection point 312 and the bottom structure 320 at another end at connection point 322. In alternate embodiments, a single structural support element may be threaded or weaved through multiple connection points 312 and extend throughout all or a portion of the interior of the air mattress or other gas-inflatable structure.

FIG. 3C illustrates air mattress embodiment 300 as seen from a top view (e.g., as a mattress would be seen if looking down on it while it is lying on the floor). Structural support elements 330 are shown in this view internal to the mattress 300 as dashed lines. Corners and/or sides may optionally be connected as shown at corner 344, such as through use of structural support elements 345 connecting between an attachment point 312 and the corner 344.

Figure 4A:
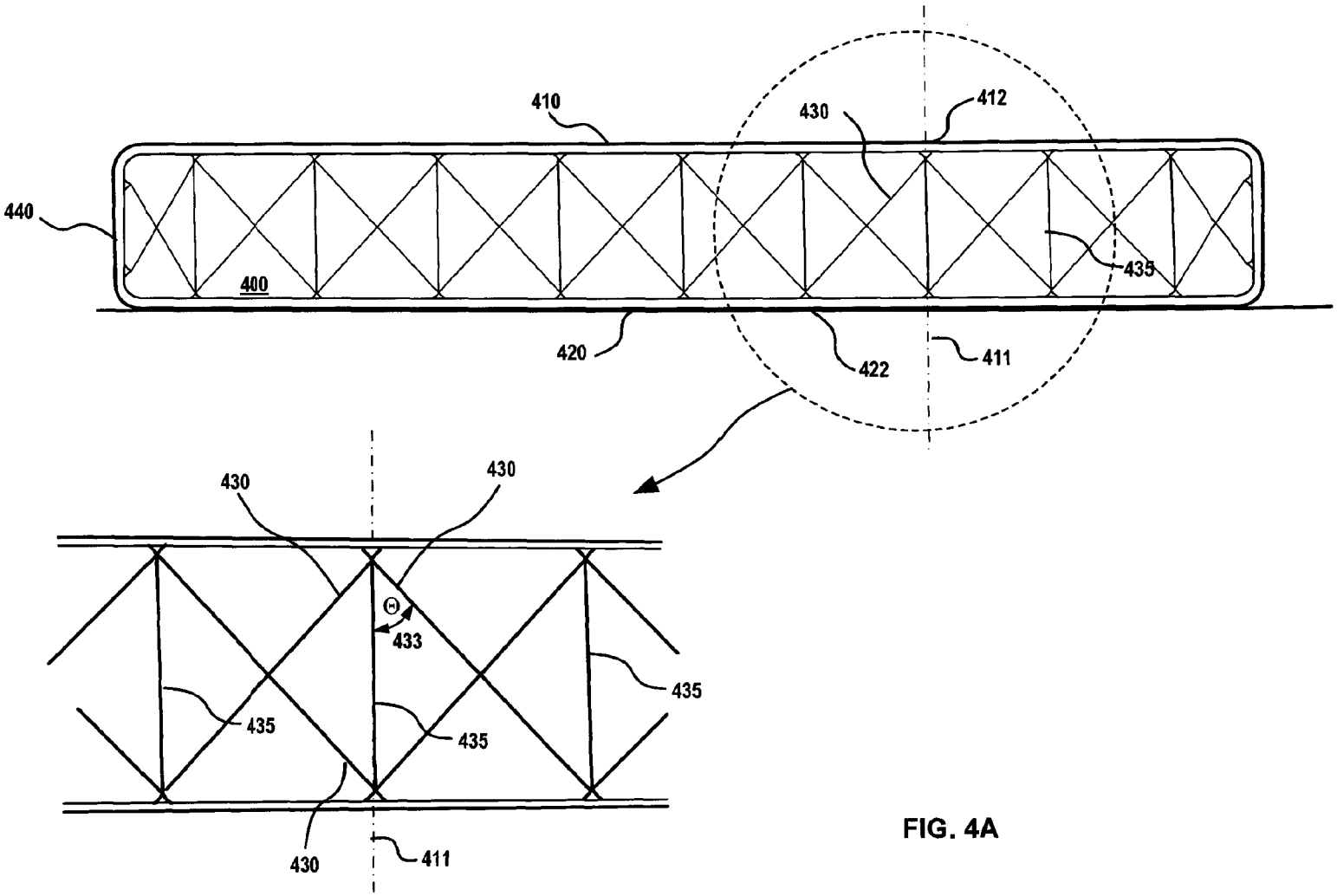
FIGS. 4A-4B illustrate details of another embodiment of an air mattress having internal diagonal structural support elements along with vertical support elements, in accordance with aspects of the present disclosure.
Figure 4B:
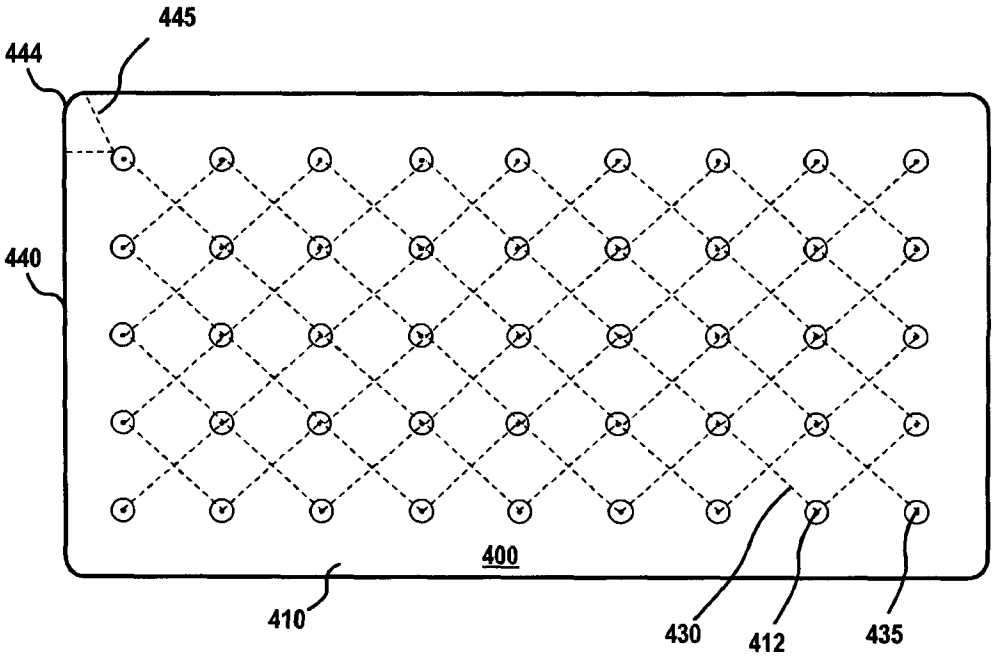

FIGS. 4A and 4B illustrate details of an alternate embodiment 400. Embodiment 400 may be configured similarly to the embodiment 300 of FIG. 3A but may also include one or more vertical (as seen from the side view) structural support elements 435 in addition to the diagonal support elements 430. The vertical structural support element 435 may be coupled between a top structure 410 and bottom structure 420, which may be a plastic sheet, e.g., PVC, etc. or other material. The vertical structural support element 435 may be oriented along axis 411 as shown, wherein the diagonal support elements are oriented at a non-zero angle Θ (Theta), (433 in FIG. 4A), as shown. Both vertical 435 and diagonal 430 support elements may be coupled to the top and/or bottom surfaces at connection points 412 as shown, and may be affixed in a rigid or movable fashion as described previously with respect to embodiment 300. The vertical support elements 435 may be rigid or flexible cords, cables, chains, straps, and the like.

FIG. 4B illustrates embodiment 400 from a top view showing the internal support element configuration for diagonal support elements 430 and vertical support elements 435 (shown in FIG. 4B as a dot representing their orientation up/down relative to the top view shown.

Figure 5:
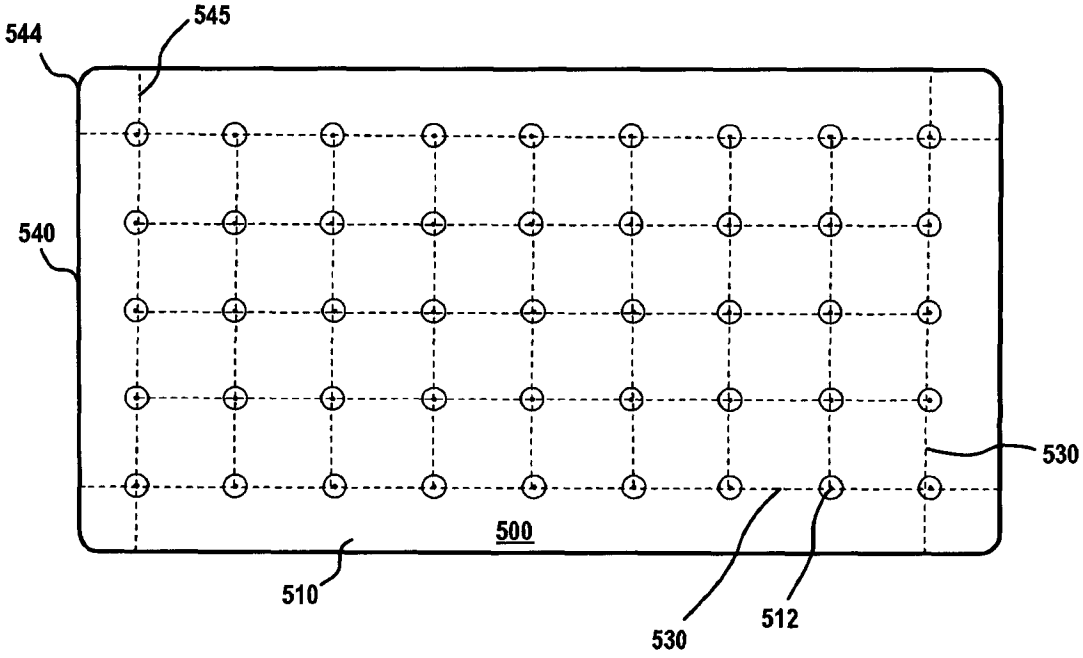
FIG. 5 illustrates details of another embodiment of an air mattress having a horizontal-vertical (as seen from above) internal diagonal support structure, in accordance with aspects of the present disclosure.

FIG. 5 illustrates details of another embodiment 500 of an air mattress, in top view, in accordance in accordance with certain aspects. Embodiment 500 may be configured similarly to the other embodiments described elsewhere herein and may include, as shown, internal support elements 530 arrayed in vertical and/or horizontal orientations (as seen from the top) as shown. This configuration contrasts slightly from the configuration of embodiment 400 where the support elements 430 are arrayed in a diagonal arrangement (as seen from the top view) rather than in a horizontal/vertical grid as shown in FIG. 5.

In embodiment 500, additional stabilization for corner 544, in the form of additional support elements 545, as shown in dashes, may optionally be included. In this configuration, one or more additional support elements may be coupled between various internal points and the corner 544 so as to provide additional cross-support to keep the side from collapsing under load and/or to provide more rigidity.

Vertical elements (as seen in a side view such as that of FIG. 4A as elements 435, may also be used and may be coupled to the top structure 510 at connection points 512 (and to corresponding points on a bottom structure (not shown). Structural support elements 530 may also be coupled between the air mattress top element 510 and bottom element, and the support elements may be, for example, rigid or flexible cords, cables, or other structures such as straps, inflatable elements, etc. The support elements may attach at internal connection points 512 and/or at side connection points on side 540 and/or corner connection points 545 in a fixed attachment, such as at the ends of the support elements via a sewed or glued connection or other fixed connection, or in a movable connection, such as through an internal loop, hook, slider, etc.

In the configuration shown, horizontal and vertical (as seen from the top) elements are used, however, in various alternate embodiments elements 530 may be oriented in place of or in addition to those shown in diagonal configurations such as shown elsewhere here. For example, additional or alternate elements may be used in various other configurations in vertical and diagonal positioning, and diagonal support elements 530 may extend to the one or more of the additional sides (not shown) and/or one or more corners (e.g., to corner 544 or other corners) of the air mattress. Similar configurations may be used in other inflatable structures such as inflatable chairs, couches, tables, and the like.

Figure 6:
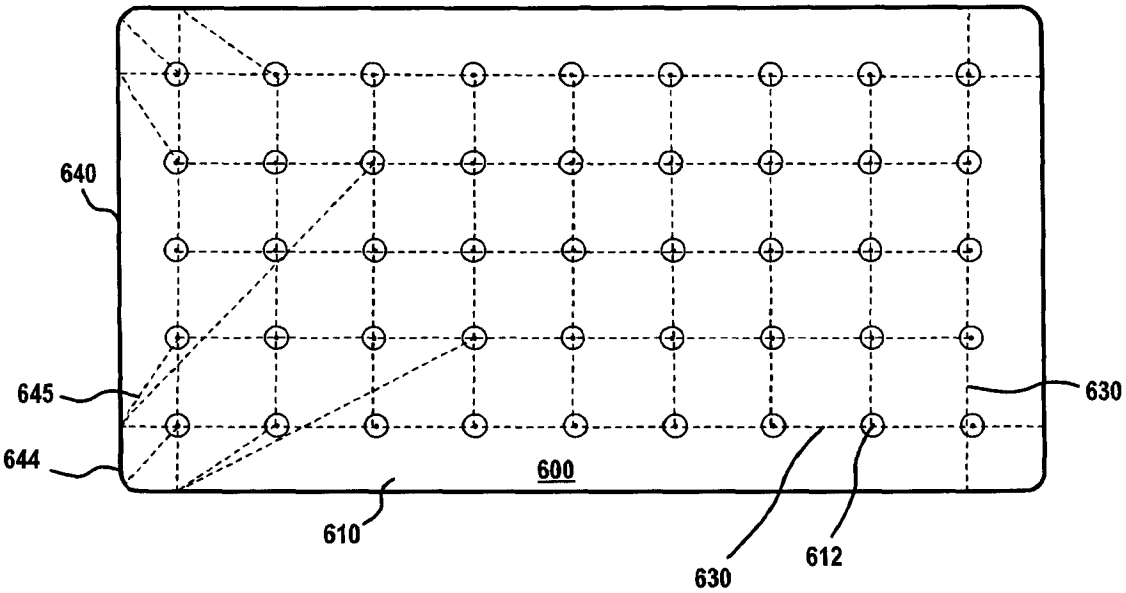
FIG. 6 illustrates details of another embodiment of an air mattress having an internal support structure for enhanced corner stabilization, in accordance with aspects of the present disclosure.

FIG. 6 illustrates details of yet another embodiment 600 of an air mattress, in top view, in accordance in accordance with certain aspects. Embodiment 600 may be configured similarly to the other embodiments described elsewhere herein and may include, as shown, internal support elements 630 arrayed in diagonal (as seen from the top) and/or horizontal/vertical orientations (as seen from the top) as shown. In embodiment 600, additional stabilization for corner 644, in the form of additional support elements 645, as shown in dashes, is included. In this configuration, one or more additional support elements may be coupled between various internal points and the corner 644 so as to provide additional cross-support to keep the side from collapsing under load and/or to provide more rigidity.

Vertical elements (as seen in a side view such as that of FIG. 4A as elements 435, may also be used and may be coupled to the top structure 610 at connection points 612 (and to corresponding points on a bottom structure (not shown). Structural support elements 630 may also be coupled between the air mattress top element 610 and bottom element, and the support elements may be, for example, rigid or flexible cords, cables, or other structures such as straps, inflatable elements, etc. The support elements may attach at internal connection points 612 and/or at side connection points on side 640 and/or corner connection points via support elements 645 in a fixed attachment, such as at the ends of the support elements via a sewed or glued connection or other fixed connection, or in a movable connection, such as through an internal loop, hook, slider, etc.

In the configuration shown, horizontal and vertical (as seen from the top) elements are used, however, in various alternate embodiments elements 630 may be oriented in place of or in addition to those shown in diagonal configurations such as shown elsewhere here. For example, additional or alternate elements may be used in various other configurations in vertical and diagonal positioning, and diagonal support elements 630 may extend to the one or more of the additional sides (not shown) and/or one or more corners (e.g., to corner 644 or other corners) of the air mattress. Similar configurations may be used in other inflatable structures such as inflatable chairs, couches, tables, and the like.

Figure 7:
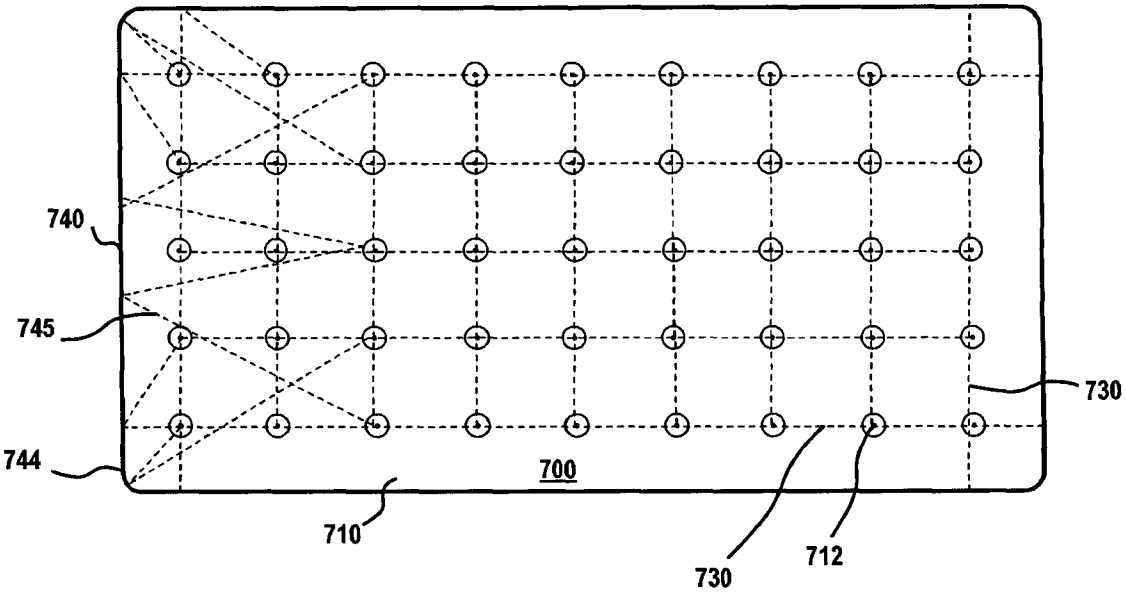
FIG. 7 illustrates details of another embodiment of an air mattress having an internal support structure for enhanced side stabilization, in accordance with aspects of the present disclosure.

FIG. 7 illustrates details of yet another embodiment 700 of an air mattress, in top view, in accordance in accordance with certain aspects. Embodiment 700 may be configured similarly to the other embodiments described elsewhere herein and may include, as shown, internal support elements 730 arrayed in diagonal (as seen from the top) and/or horizontal orientations as shown. In embodiment 700, additional stabilization for side 740, in the form of additional support element 730 as shown in dashes, is included. In this configuration, one or more additional support elements may be coupled between various internal points and the side 740 so as to provide additional cross-support to keep the side from collapsing under load and/or to provide more rigidity.

Vertical elements (as seen in a side view such as that of FIG. 4A as elements 435, may also be used and may be coupled to the top structure 710 at connection points 712 (and to corresponding points on a bottom structure (not shown). Structural support elements 730 may also be coupled between the air mattress top element 810 and bottom element, and the support elements may be, for example, rigid or flexible cords, cables, or other structures such as straps, inflatable elements, etc. The support elements may attach at internal connection points 812 and/or at side connection points on side 740 in a fixed attachment, such as at the ends of the support elements via a sewed or glued connection or other fixed connection, or in a movable connection, such as through an internal loop, hook, slider, etc. In this configuration, horizontal and vertical (as seen from the top) elements are used, however, in various alternate embodiments elements 730 may be oriented in place of or in addition to those shown in diagonal configurations such as shown elsewhere here. For example, additional or alternate elements may be used in various other configurations in vertical and diagonal positioning, and diagonal support elements 730 may extend to the one or more of the additional sides (not shown) and/or one or more corners (e.g., to corner 744 or other corners) of the air mattress. Similar configurations may be used in other inflatable structures such as inflatable chairs, couches, tables, and the like.

Figure 8:
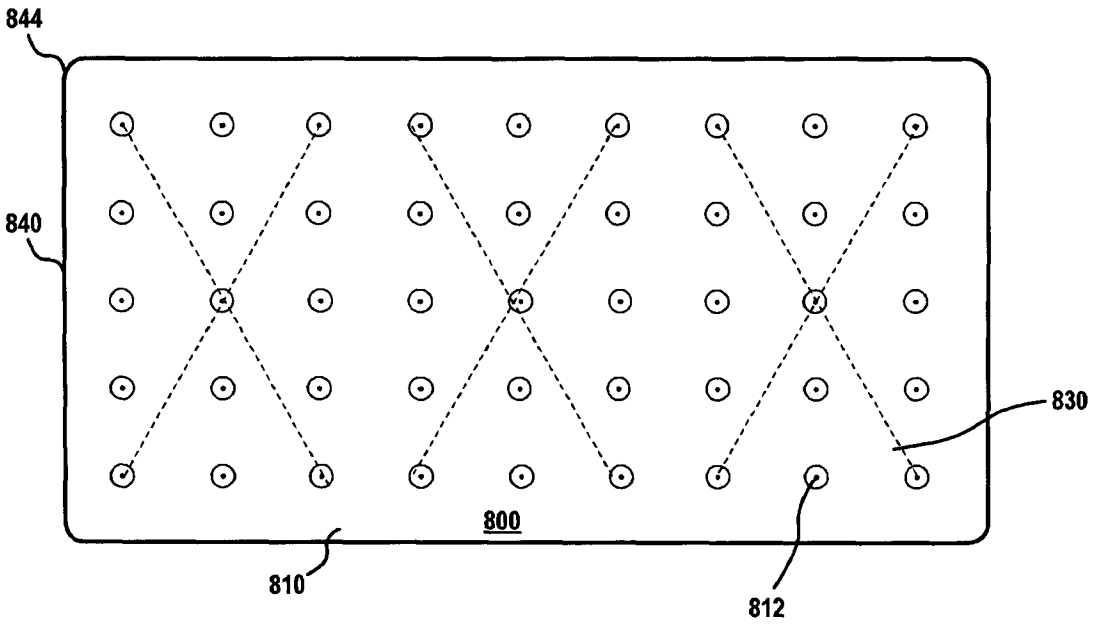
FIG. 8 illustrates details of another embodiment of an air mattress having an alternate internal diagonal support structure, in accordance with aspects of the present disclosure.

FIG. 8 illustrates details of yet another embodiment 800 of an air mattress, in top view, in accordance in accordance with certain aspects. Embodiment 800 may be configured similarly to the other embodiments described elsewhere herein and may include, as shown, internal support elements 930 arrayed in a diagonal (as seen from the top) orientation. As shown in FIG. 8, vertical elements (as seen in a side view such as that of FIG. 4A as elements 435, may be coupled to the top structure 810 at connection points 812 (and to corresponding points on a bottom structure (not shown). Structural support elements 830 may be also be coupled between the air mattress top element 810 and bottom element, and the support elements may be, for example, rigid or flexible cords, cables, or other structures such as straps, inflatable elements, etc. The support elements may attach at certain of the internal connection points 812 in a fixed attachment, such as at the ends of the support elements via a sewed or glued connection or other fixed connection, or in a movable connection, such as through an internal loop, hook, slider, etc. In this configuration, a smaller number of diagonal elements 830 than shown in the embodiment of FIG. 3 are used, along with vertical support elements. Additional or alternate elements may be used in various other configurations in vertical and diagonal positioning, and diagonal support elements 830 may extend to the one or more of the sides (not shown) and/or one or more corners of the air mattress. Similar configurations may be used in other inflatable structures such as inflatable chairs, couches, tables, and the like.

Figure 9:
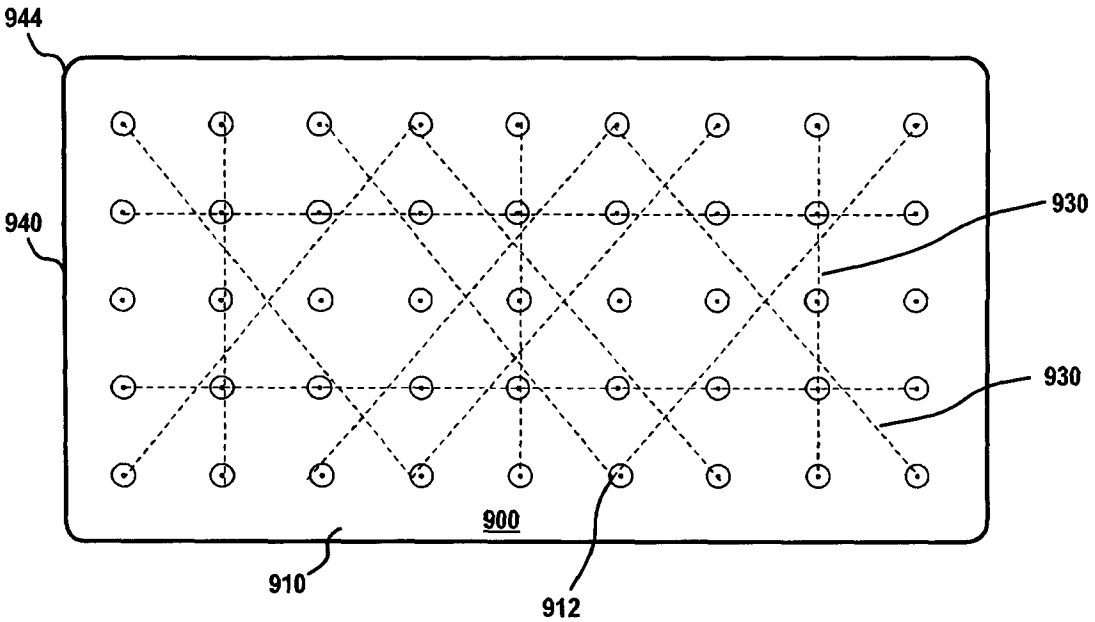
FIG. 9 illustrates details of another embodiment of an air mattress having an alternate internal diagonal support structure with additional horizontal and vertical (as seen from above) elements, in accordance with aspects of the present disclosure.

FIG. 9 illustrates details of yet another embodiment 900 of an air mattress, in top view, in accordance in accordance with certain aspects. Embodiment 900 may be configured similarly to the other embodiments described elsewhere herein and may include, as shown, internal support elements 930 arrayed in a diagonal (as seen from the top) and horizontal and/or vertical (also as seen from the top) orientation. The elements 930 may be coupled between the air mattress top element 910 and a bottom element (not shown) and the support elements may be, for example, rigid or flexible cords, cables, or other structures such as straps, inflatable elements, etc. The support elements may attach at internal connection points 912 in a fixed attachment, such as at the ends of the support elements via a sewed or glued connection or other fixed connection, or in a movable connection, such as through an internal loop, hook, slider, etc. Additional or alternate elements may be used in various other configurations in vertical, horizontal, and/or diagonal positioning, and support elements may extend to one or more of the sides (not shown) and/or one or more of the corners of the air mattress. Similar configurations may be used in other inflatable structures such as inflatable chairs, couches, tables, and the like.

Figure 10:
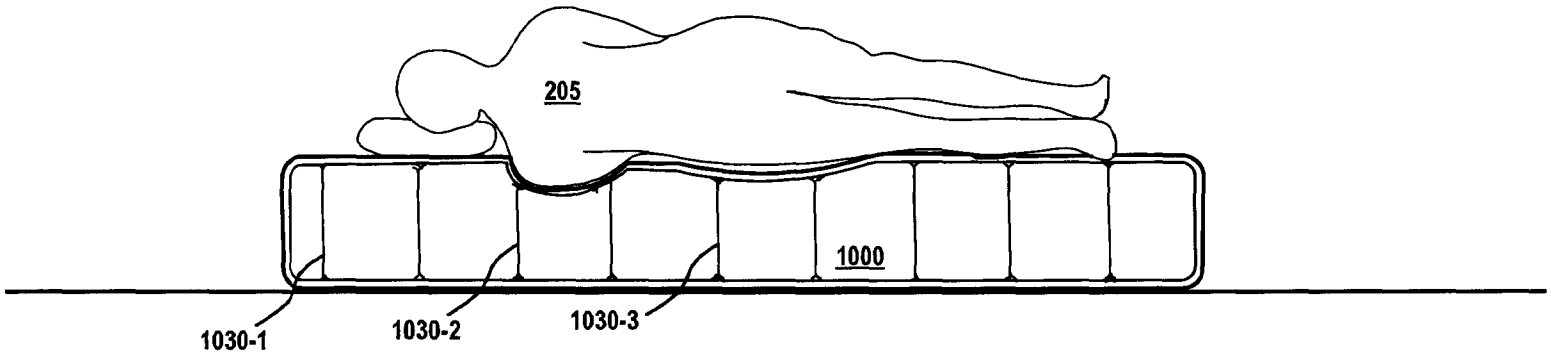
FIG. 10 illustrates details of another embodiment of an air mattress having an alternate internal diagonal support structure with structural support elements of varying lengths and/or other properties, in accordance with aspects of the present disclosure.

In another aspect, air mattresses or other gas-inflatable structures in various configurations as described previously herein or in other configurations may be further configured with internal structural support elements having varying lengths and/or varying structural properties. One example embodiment of such a configuration is shown in embodiment 1000 of FIG. 10. In this embodiment showing an air mattress in side-view cross-section, similar to the configuration shown in FIG. 2, structural support elements 1030 of varying lengths may be used so as to match desired load characteristics, such as, for example, varying loading as may be applied by different parts of the human body when placed on the air mattress. In the example shown, structural element 1030 may include sub-elements of different lengths. For example, sub-element 1030-1 may be longer than sub-elements 1030-2 and 1030-3 as shown, with the lengths adjusted based on normal or typical loading. Other parameters of the structural support elements 1030, which may be of similar types to those structural support elements described elsewhere herein, may be varied, such as rigidity or flexibility, thickness, shape, attachment to the top and/or bottom, and the like. For example, certain of the structural support elements may be of a more (or less) rigid material depending on the expected loading to be placed on that area of the air mattress or other gas-inflatable structure.

Figure 11:
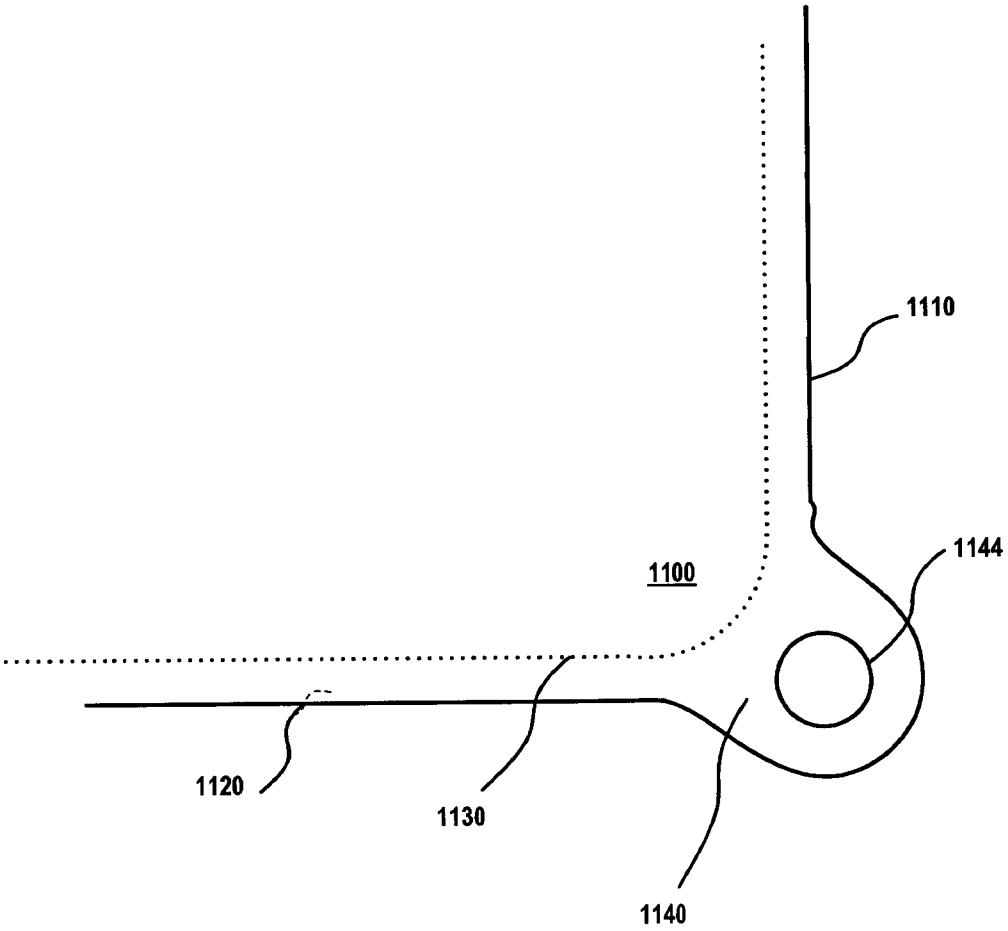
FIG. 11 illustrates details of another embodiment of an air mattress having an integral handle, in accordance with aspects of the present disclosure.

In another aspect, air mattresses or other gas-inflatable structures in various configurations as described previously herein or in other configurations may be further configured with an integral handle. The integral handle may be formed on the corners, sides, top, or bottom of the mattress or other structure. An example embodiment of an integral handle 1140 is shown in the air mattress embodiment 1100 of FIG. 11. In this embodiment, the integral handle 1140 is formed at a corner of the air mattress 1100. Air mattress 1100 may be constructed by bonding top and bottom structures 1110 and 1120 which may, for example, be plastic materials such as PVC or TPU sheets or other materials such as fabric, polymers, etc. An example bonding or welding seam 1130 is shown in FIG. 11. The top and bottom structures may be formed with a handle opening 1144, or the opening may be cut out after the top and bottom sheets are bonded to provide an opening for a user to grip the mattress or other structure. In some embodiments, the top and bottom may be precut with the opening 1144, or, in other embodiments, the opening 1144 may be cut after the top and bottom sheets are bonded. The opening 1144 may be formed in various shapes to match or contour to a user's hand or other element with which the structure is moved by. Likewise, similar openings may be formed in other areas of air mattresses or other gas inflatable structures in alternate embodiments, based on particular lifting or movement requirements.

It will be apparent in view of the above disclosures that various additional and/or alternate embodiments and configurations may be implemented. For example, various alternate internal interconnect configurations of cords, cables, or other support structures, which may be rigid, flexible, or part rigid and part flexible, may be used in various embodiments. Internal support structures may be single cords/cables that are connected at their ends to the top, bottom, or sides of the air mattress at specific points, or may be a single or multiple cords or cables that are weaved, threaded, or otherwise coupled at various attachment points throughout the interior of the air mattress or other inflatable structure. For example, in some embodiments, a single cord or cable may be threaded through loops or hooks within the air mattress and connected only at one or both ends. In other embodiments, a separate cord, cable or other support element may be attached or coupled at both ends at internal connection points so that the internal support structure comprises multiple separate cords or cables. In some embodiments, various aspect of the previously shown examples may be combined, in whole in part, to form other air mattress implementations. For example, integral end handles may be formed in an air mattress with internal diagonal support structures as shown and/or with corner or side support structures as shown.

Skilled artisans may implement the described functionality in varying ways for each particular application, but such implementation decisions should not be interpreted as causing a departure from the scope of the present disclosure.

The scope of the present invention is not intended to be limited to the aspects shown herein, but is to be accorded the full scope consistent with the specification and drawings, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c.

The previous description of the disclosed aspects is provided to enable any person skilled in the art to make or use embodiments of the presently claimed invention. Various modifications to these aspects will be readily apparent to those skilled in the art, and the generic principles defined herein may be applied to other aspects without departing from the spirit or scope of the disclosures herein. Thus, the presently claimed invention is not intended to be limited to the aspects shown herein, but is to be accorded the widest scope consistent with the disclosures herein and their equivalents.

We claim:

1. An air mattress comprising;
a top element;
a bottom element;
one or more side elements; and
an internal structure comprising one or more diagonal structural support element coupled between at least the top element and the bottom element and wherein the one or more diagonal structural support members comprises a plurality of structural support elements and wherein a first of the plurality of structural support elements has a different flexibility than a second of the plurality of structural support elements.

2. The air mattress of claim 1 wherein the one or more diagonal structural support members comprises a plurality of structural support elements and wherein a first of the plurality of structural support elements has a different width than a second of the plurality of structural support elements.

3. The air mattress of claim 1 wherein the one or more diagonal structural support elements are flexible cords or cables.

4. The air mattress of claim 1 further comprising an internal structural support element coupled between the top or bottom elements and a corner of the air mattress.

5. The air mattress of claim 1 further comprising an internal structural support element coupled between the top or bottom elements and a side of the air mattress.

6. The air mattress of claim 1 wherein the one or more diagonal structural support members comprises a plurality of structural support elements and wherein a first of the plurality of structural support elements has a different length than a second of the plurality of structural support elements.

7. The air mattress of claim 1 further comprising an integral handle.

8. The air mattress of claim 7 wherein the integral handle is disposed on a corner of the air mattress.

9. The air mattress of claim 7 wherein the integral handle is disposed on a side of the air mattress.

10. An air mattress comprising;
a top element;
a bottom element;
one or more side elements; and
an internal structure comprising one or more diagonal structural support element coupled between at least the top element and the bottom element and wherein the one or more diagonal structural support members comprises a plurality of structural support elements and wherein a first of the plurality of structural support elements has a different width than a second of the plurality of structural support elements.

11. The air mattress of claim 10 further comprising an integral handle.

12. The air mattress of claim 11 wherein the integral handle is disposed on a corner of the air mattress.

13. The air mattress of claim 11 wherein the integral handle is disposed on a side of the air mattress.

14. The air mattress of claim 10 wherein the one or more diagonal structural support elements are flexible cords or cables.

15. The air mattress of claim 10 further comprising an internal structural support element coupled between the top or bottom elements and a corner of the air mattress.

16. The air mattress of claim 10 further comprising an internal structural support element coupled between the top or bottom elements and a side of the air mattress.

17. The air mattress of claim 10 wherein the one or more diagonal structural support members comprises a plurality of structural support elements and wherein a first of the plurality of structural support elements has a different length than a second of the plurality of structural support elements.

* * * * *